United States Patent [19]

Mincher

[11] 4,412,357

[45] Nov. 1, 1983

[54] SHIRT

[76] Inventor: Sally Mincher, 104 Live Oak Dr., Wrightsville Beach, N.C. 28480

[21] Appl. No.: 220,689

[22] Filed: Dec. 29, 1980

[51] Int. Cl.[3] ..... A41B 1/18

[52] U.S. Cl. ..... 2/118; 128/442

[58] Field of Search ..... 2/118, 269, 237, 197, 2/115, DIG. 6, 75, 102; 128/442

[56] References Cited

U.S. PATENT DOCUMENTS

| | | | |
|---|---|---|---|
| 668,683 | 9/1901 | Johnson | 2/118 |
| 2,846,686 | 8/1958 | Tames | 2/269 |
| 3,110,903 | 11/1963 | Burchard | 2/237 |
| 3,997,982 | 12/1976 | Holland | 2/102 |
| 4,172,292 | 10/1979 | Horton | 2/75 |

*Primary Examiner*—Doris L. Troutman

[57] ABSTRACT

A knit shirt for female athletes is provided with straps for selectively and adjustably constraining the breasts of an athlete wearing the shirt. Three sets of straps having mating Velcro surfaces are shown. An optional applique panel is illustrated.

7 Claims, 3 Drawing Figures

SHIRT

TECHNICAL FIELD

This invention relates to an improved shirt for a female athlete.

BACKGROUND ART

A female who engages in strenuous exercise such as jogging, competitive running, basketball, etc. faces substantial discomfort and possibly a serious health threat if her breasts are not properly constrained during such activity. Discomfort may be in the form of muscle soreness or skin irritation due to chaffing.

Unfortunately, brassieres do not provide a solution to these problems. While a brassiere may provide support, it may also cause skin irritation and very substantial discomfort. Additionally, brassieres do not have any provision for quickly and easily releasing and engaging them so as to provide some comfort during a recess in activity.

DISCLOSURE OF THE INVENTION

In accordance with the present invention an improved shirt for a female athlete comprises a body for completely encircling the torso of a female athlete from the waist up to the neck. The body comprises connected front and rear panels. The front panel comprises means for covering the breast and stomach regions and the rear panel comprises means for covering the athlete's back. Adjusting means are attached to the exterior of the front panel for selectively and adjustably constraining the breasts of a female athlete.

Advantageously, the athlete wearing this improved shirt may readily adjust the constraining forces so as to achieve maximum personal comfort, and the adjusting means may be fully released with ease to eliminate the constraining forces during periods of rest.

THE DRAWING

DETAILED DESCRIPTION

Figure 1:
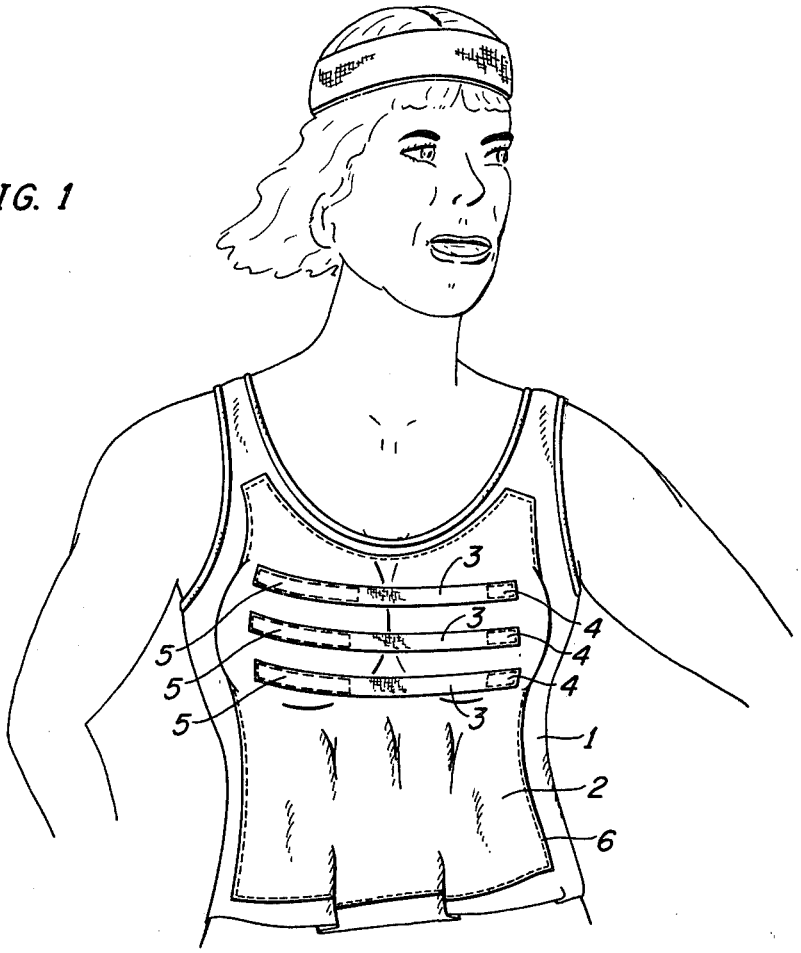
FIG. 1 shows the upper body of a female athlete draped with an athletic shirt in accordance with one illustrative embodiment of this invention.

FIG. 1 shows a female athlete wearing an improved sleeveless shirt in accordance with one embodiment of this invention. The shirt of FIG. 1 comprises a body 1 which comprises a front panel which covers the breast and stomach regions and a rear panel (not shown) which covers the athlete's back. The front and rear panels may be of a continuous piece of material or they may be connected independent panels. The shirt body 1 completely encircles the female athlete from the waist up to the region of the neck as is illustrated. Although not shown in any of the Figs. of the drawing, the back panel is continuous. Advantageously, the shirt body may be of a knitted fabric which provides some elasticity to the garment.

In the illustrative embodiment of FIG. 1 there is shown an applique panel 2 which is attached to the exterior of the front panel by the stitching 6. The applique panel may advantageously be of an inelastic woven material or it may be of a knitted material. The applique panel is not essential to the practice of this invention; however, it may be utilized to reduce the elasticity of the knitted body or to provide a decorative ornamentation. The term elastic as used herein is not intended to be limited to highly resilient materials which have a strong tendency to return to their original shapes, but also includes materials which may be stretched and which have only a minor tendency to return to their original shapes.

In FIG. 1 there are shown three adjustable strap arrangements attached to the applique panel 2. Each such strap arrangement comprises a strap 3 which has a loose end which is attached by stitching to applique panel 2 at a location 4 which is over a portion of the athlete's left breast. The loose end of the strap 3 extends across the athlete's breasts. The loose end of the strap 3 is adapted to be selectively and adjustably engaged with the strap segment 5 which is attached by stitching over a portion of the athlete's right breast. The straps 3 and the strap segments 5 are shown engaged in FIG. 1 and disengaged in FIG. 2. In one embodiment of this improved athletic shirt, the strap 3 and the strap segment 5 may be of two complimentary materials having mating surfaces, one type of such materials is called Velcro. The one material has a large number of closely spaced projections on one of its surfaces and the other material has a strong but fluffy exposed surface which is adapted to be selectively engaged and disengaged with the surface projections of the first material. With this arrangement the athlete can easily obtain the desired constraining force. Furthermore, with this arrangement the athlete can easily disengage the strap 3 from the strap segment 5 so as to reduce the forces during periods of rest.

In the drawing each figure illustrates the use of three straps and three strap segments. This number of strap adjusting means is but for puspose of illustration and is not intended to be in any way limiting. For example, in some instances one adjusting strap means may suffice while in other instances two, three or more strap adjusting means may provide the most comfort.

Figure 2:
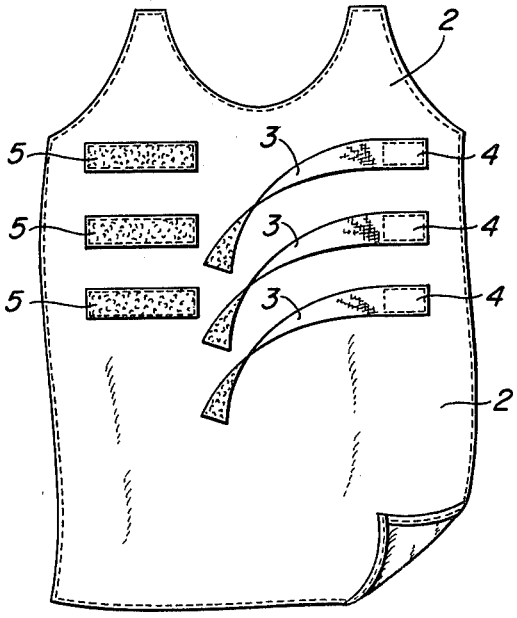
FIG. 2 shows an applique panel for a shirt such as the one shown in FIG. 1.

FIG. 2 shows an applique panel 2 such as the one shown attached by stitching to the shirt in FIG. 1. In FIG. 2 three strap adjusting means are shown attached to the exterior of the applique panel as described with respect to FIG. 1.

Figure 3:
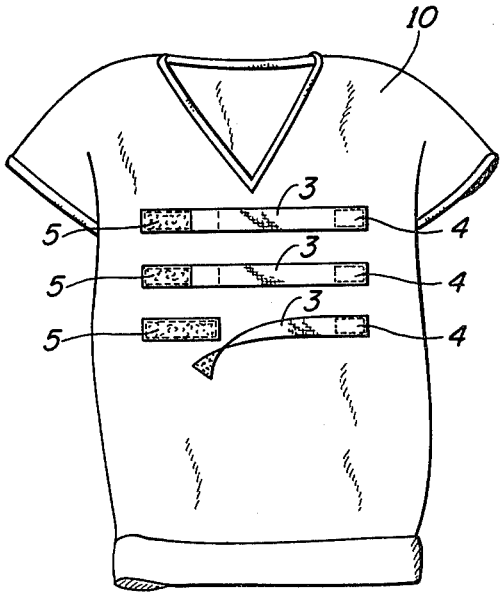
FIG. 3 shows an athletic shirt with short sleeves and adjusting means as a further illustrative embodiment of this invention.

FIG. 3 illustrates a Vee necked athletic shirt with short sleeves and strap adjusting means similar to those illustrated in the other figures. As shown in FIG. 3, the strap adjusting means are attached to the exterior of the shirt 10 in locations comparable to those shown in the other figures of the drawing.

In the drawing the strap adjusting means are illustrated as having cooperating mating surfaces such as those provided by Velcro. Other means of cooperation between the straps 3 and the strap segments 5 may be utilized so long as they are continuously adjustable and can be easily disengaged to reduce the constraining forces.

I claim:

1. An improved shirt for female athletes comprising: a shirt body for completely encircling and covering the torso of a female athlete from the waist up; said shirt body comprising permanently joined front and rear panels, said front panel comprising means for covering an athlete's breasts and abdomen and said rear panel comprising means for covering an athlete's back; and adjusting means attached to the exterior of said front panel for selectively and adjustably applying constraining forces to the breasts of an athlete wearing the shirt 2. An improved shirt in accordance with claim 1, wherein said adjusting means comprises at least one adjusting strap arrangement.

3. An improved shirt in accordance with claim 2, wherein said adjusting strap arrangement comprises a strap set consisting of first and second straps; means for attaching said first and second straps to the exterior of said front panel at locations respectively over the left and right breasts of an athlete wearing the shirt; said first strap overlies a portion of said second strap, and said adjusting strap arrangement comprises means for selectively and adjustably engaging said first strap and said second strap.

4. An improved athletic shirt in accordance with claim 1, wherein said adjusting means comprises three independently adjustable sets of straps.

5. An improved shirt in accordance with claim 3 wherein one surface of said first strap has a large number of closely spaced protruderances and an exposed surface of said second strap has a mating surface for selectively engaging said one surface of said first strap.

6. An improved athletic shirt in accordance with claim 1 wherein said shirt is a knit athletic shirt.

7. An improved althletic shirt in accordance with claim 6, wherein said shirt body further comprises a woven applique panel attached to said front panel of said shirt.

* * * * *